US005779558A

United States Patent [19]

Britton

[11] Patent Number: 5,779,558

[45] Date of Patent: Jul. 14, 1998

[54] GOLF PUTTER

[76] Inventor: Richard Britton, 2963 Quedada St., Newport Beach, Calif. 92660

[21] Appl. No.: 597,856

[22] Filed: Feb. 7, 1996

[51] Int. Cl.[6] ..... A63B 53/14

[52] U.S. Cl. ..... 473/286; 473/285; 473/282

[58] Field of Search ..... 473/286, 282, 473/285, 300

[56] References Cited

U.S. PATENT DOCUMENTS

| | | | |
|---|---|---|---|
| D. 205,672 | 9/1966 | Andis . | |
| 3,774,913 | 11/1973 | Duen | 473/286 X |
| 3,791,652 | 2/1974 | Schuler | 473/286 |
| 4,073,492 | 2/1978 | Taylor . | |
| 4,136,877 | 1/1979 | Antonious . | |
| 4,239,216 | 12/1980 | Bauer | 473/286 X |
| 4,799,684 | 1/1989 | Rango . | |
| 4,815,739 | 3/1989 | Donica . | |
| 4,862,970 | 9/1989 | Hlavacek | 473/286 X |
| 4,892,314 | 1/1990 | Rango | 473/286 |
| 4,925,190 | 5/1990 | Learned | 473/286 |
| 4,955,609 | 9/1990 | Kassen | 473/286 |
| 5,377,977 | 1/1995 | MacNeary | 473/286 |
| 5,423,543 | 6/1995 | Tarrant | 473/286 |
| 5,470,063 | 11/1995 | Fisher . | |
| 5,511,785 | 4/1996 | Rusin, Jr. | 473/286 |

*Primary Examiner*—Raleigh W. Chiu
*Attorney, Agent, or Firm*—Hill & Simpson

[57] ABSTRACT

A golfer putter is provided which includes a ball mark repair tool which is integrally stored on a grip of the putter. The repair tool has at least two tines which are received in the grip so that they remain outside of the putter shaft.

2 Claims, 1 Drawing Sheet

GOLF PUTTER

BACKGROUND OF THE INVENTION

The present invention generally relates to a golf putter. More specifically, the present invention relates to a "PLUM-LINE PUTTER" having multiple fixed angles or an adjustable-lie hosel, an interchangeable and weighted striking face plate for providing various lofts and weights, a sole shape facilitating loft lie and directional alignment while resting on the ground, improved sight aligning and aiming features, and a grip having an integrally-stored ball marker and divot repair tool.

Putting performance is greatly dependent on a golfer's ability to precisely align and aim the club head relative to the ball and hole. Therefore, a goal in putter design has been to provide sighting aids which assist a golfer in achieving correct alignment and optimum aim.

Proper club alignment is desired in the lie, loft, striking direction, and parallel-to-the-ground striking point on the club face. These terms, as used herein, have meanings conventional in golf: "lie" is an angle between a heel-to-toe line and an axis of the shaft; "loft" is an angle of the striking face plane from vertical; "striking direction" a vector parallel to the ground and which is 90° from the striking face.

In order to assist a golfer to visually align a putter head, club heads are known to have visual markings. In a textbook putting stance, a golfer's eyes should be generally looking vertically downward over a centerline of the putter head. Thus, visual markings are generally designed to help a golfer align the club from this perspective. Much study has been directed toward attempts to improve a putter's ease of visual alignment. For example, U.S. Pat. No. 4,136,877 relates to a putter having markings on two vertical levels, the alignment of the markings indicating whether the club head is level.

Because golfers vary in body size and proportion, optimum club design varies from person to person. The angle of the club head relative to the shaft, or "lie," is one such design aspect which must be determined for each golfer. Therefore, for a custom fit, it is desirable to provide a hosel which provides multiple fixed lie angles or adjustability of the lie.

Adjustable-lie putters, although rare, have previously been attempted. One known type has a ball-and-socket structure integral to a heel of the putter head to which the shaft is attached. By rotating the shaft, a screw mechanism loosens and tightens the ball in the socket at a selected orientation. The "Sprague Patent Putter," circa 1903, and a "Zebra" putter, circa 1970, each incorporate such a feature. Another known adjustable-lie putter known as a "Select-A-Putt," U.S. Des. Pat No. 205,672 has an expandable friction lock between the shaft and putter head at an apex of the center and face of the putter head. A putter known as the "Barnes Patent Putter", made around the early or mid-1920's, has a locking tooth mechanism between the s haft and putter head, located at an apex of the heel and face of the putter head. That system permits lie adjustment in only a few finite increments.

Unfortunately, the USGA rules forbid readily adjustable putters. Specifically, "... forms of adjustability are permitted in the design of a putter, provided that: (i) the adjustment cannot be readily made; (ii) all adjustable parts are firmly fixed and there is no reasonable likelihood of them working loose during a round ..." USGA Rules of Golf, Rule 4-la (1995) (in pertinent part). The USGA interpreted this rule as prohibitive of an arrangement which was merely tightened by a set screw. It is desirable to provide a putter with an adjustable-lie hosel which is permissible for play within the rules of golf.

Golf etiquette requires a golfer to repair turf damage such as ball marks or divots. Special pocket-sized ball mark repair tools are known, and usually include one or two tines. It is desirable to provide such a tool which is integral to some other golf equipment item. For example, U.S. Pat. No. 4,799,684 relates to a divot repair tool which fits into a putter shaft atop the putter grip. Disadvantageously, that configuration fully exposes an open shaft interior, thus subjecting the shaft to receiving debris such as dirt, pebbles, grass, and water. It is very undesirable to accumulate such debris inside a club shaft, as the shaft may eventually rust and/or become improperly weighted. Also, that known repair tool has a rubber projection which is inserted into a hole in the top of the rubber grip. This rubber-on-rubber friction can make insertion and removal of the tool difficult. Therefore, it is desirable to provide an improved putter grip arrangement with an integrally-stored a divot mark repair tool, but which does not expose an open shaft end and which is easy to remove and insert.

Putters are conventionally designed so that the striking face has a slight loft. A putter's loft generally ranges from 2°–5°, but loft may be greater or smaller, if desired. Such loft slightly lifts the ball from the green during initial contact with the putter. Such a lifting effect is, in general, usually desirable so that the ball achieves momentum in the desired direction while overcoming resistance from the turf. Without any loft, or with a negative loft, the ball may push into the turf, slowing the putt, possibly causing it to react off of the turf in an undesired direction.

Putting greens have varying characteristics. Greens may vary in softness, dampness, length and texture of grass, all factors which may effect a putt. Any one particular green may experience changed characteristics even during a day. For a particular golfer, geographic region, or differing putting green characteristics, a particular putting face may result in better control and accuracy. Therefore, it is desirable to provide a putter having a selectable putting face material, loft, profile, color, sound, reflex, vibrational feedback and/or feel.

Also, weight distribution is another important aspect of putter design. Much study has been directed to placement of concentrated weights in putters. It is desirable to provide a putter head which is weighted for optimal putter feel and balance, as well as putting distance, control and accuracy. Also, as with other putter features, it may be desirable that such weights be adjustable in amount.

SUMMARY OF THE INVENTION

In an embodiment, the adjustable hosel joint has one or more voids in which a semi-permanent adhesive may be applied to lock the second hosel member in a selected position relative to the first hosel member. The adhesive is preferably a strong thermoplastic adhesive which, when hardened, is made malleable by heat. For example, a thermoplastic epoxy resin may be used.

The hosel is positioned to a desired lie angle while the adhesive is malleable. When the adhesive hardens, the hosel is "firmly fixed" and unlikely to be worked loose during golf play. If a readjustment is subsequently necessary, the joint may be heated, such as by a blowtorch, so that the adhesive is made malleable again.

The friction bind of the tightened tapered parts would be enough to firmly fix the hosel in a manner unlikely to be worked loose. However, in combination with the adhesive, the hosel remains locked in position with virtually no chance of working loose under any normal conditions. Moreover, because a heat source is required to break the adhesive bond, an adjustment to the hosel cannot be readily made" on a golf course.

A putter according to the present invention could be set in a custom lie-angle golf gauge fitting machine. Also, it is possible that the invention could be used for golf club adjustability in applications other than an adjustable-lie putter hosel. The invention could be used in virtually any club which has at least two members which are secured together in an adjustable manner. Such a club would have a joint at which the two members are adjustably fixed the joint having frictionally-engaging components for lockable movement between the two members. In accordance with the invention, a void is defined in the frictionally-engaging components adapted to be applied with a curable adhesive for locking the frictionally engaging components together in a firmly fixed and non-"readily" adjustable manner, as in the embodiment described above. For example, such clubs could have adjustable-loft angles, telescoping shaft components, or virtually any desired club adjustment.

According to an aspect of the present invention, the present invention provides a putter with removable and interchangeable face plates. Each plate defines a striking face, and a kit may be provided in which the plates have various materials, lofts, profiles, sounds, reflexes, colors, vibrational feedbacks and/or feel.

In an embodiment of the invention, the putter head has a hollow cavity behind the removable face plate. A weight is secured to the inside of the face plate so that the weight is received within the cavity. The weight is removable and may be interchanged with other weights for a custom feel.

According to another aspect of the invention, a golf putter is provided wherein a sole of the putter head has a Radial Sole Sensors, elevating the putter bottom. The sole sensor is a part of the bottom which projects generally downwardly and forms a flat surface. This flat surface is adapted to support the putter in a "home" or reference position a golfer holds the putter so that the flat surface is flatly disposed against the ground.

The sole sensor has a generally circular, spherical edge. The edge may be a continuous circle or, in an embodiment, the sole sensor may have one flat side disposed adjacently toward a striking face of the putter so that the sole sensor is generally D-shaped. When supported on the sole sensor, the putter is rockable in any direction on the circular edge, or on the flat edge portion. A golfer can feel the "home" position, and therefore is better able to vary his overall putter lie or loft with accuracy while aiming a putt.

According to an aspect of the invention, a golf putter grip is provided having an integral divot mark repair tool. To this end, a flexible grip member has a hollow adapted receive the putter shaft. The grip member is shaped to substantially close off the hollow at a top end so that the open shaft end is not substantially exposed. The divot mark repair tool has a tool handle from which at least two generally parallel tines extend. These tines are insertable in respective bores in the grip member for storage of the tool. The bores are aligned generally parallel to the shaft, and are positioned radially outwardly from the shaft.

an another advantage of the present invention is to provide a putter having an improved divot mark repair tool and two ball markers which fit integrally into the grip.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
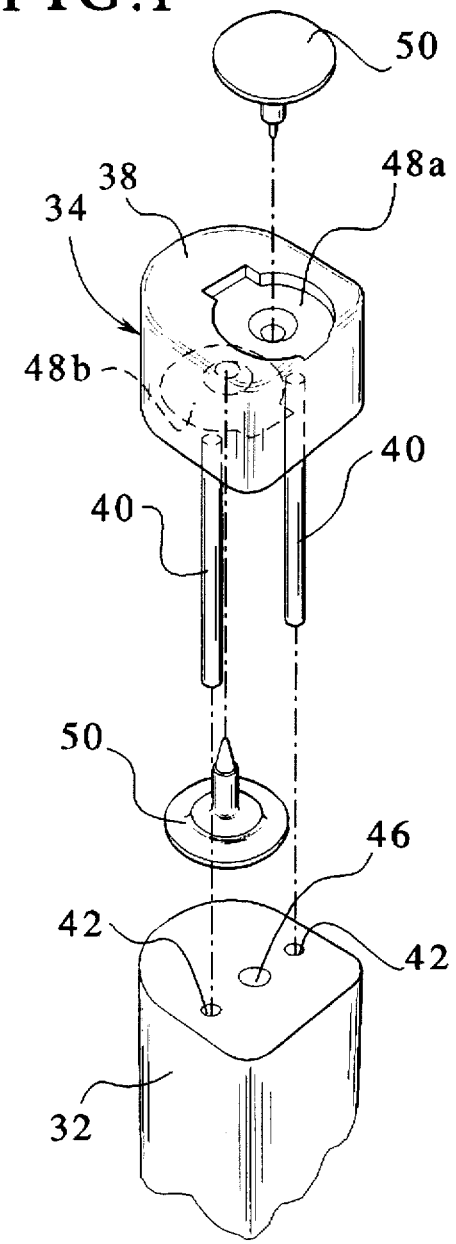
FIG. 1 is a fragmentary exploded view of a grip with an integral divot mark repair tool with two ball markers according to the present invention.
Figure 2:
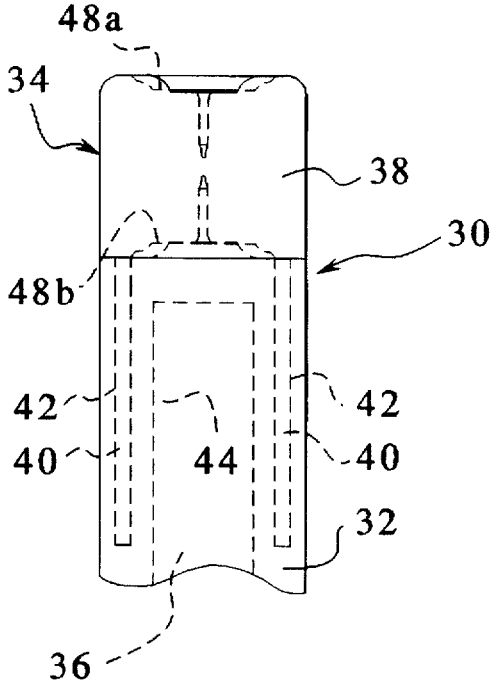
FIG. 2 is a front view of the grip of FIG. 2 with the ball-mark repair tool in an inserted position, tines of the tool and the putter shaft being shown in phantom lines.

Referring to FIGS. 1 and 2, an embodiment of the putter 12 includes a FIXX-MARK™ grip 30 including a flexible grip member 32 and an integral ball mark repair tool 34. The grip 30 is securable over a shaft 36 of the putter, seen in FIGS. 1 and 3.

The divot mark repair tool 34 has a tool handle 38 from which two tines 40 extend in a parallel manner. The tool handle 38 may be made of plastic, rubber or some other suitable material, and the tines 40 may be made of metal. The grip member 32 has bores 42 which correspond in size, depth and position of the tines 40. Thus, as shown in FIG. 2, tines 40 may be inserted into the bores 42 so that the repair tool 34 is integrally stored and secured at an end of the grip 30. The tool handle 38 is preferably sized for gripping by fingers, and has a profile continuous with the grip member 32.

The grip member 32 has a hollow 44 shaped to receive the shaft 36. The grip member 32 is shaped so that the top end of the shaft 36 and associated hollow 44 are substantially closed off. More specifically, the end of the shaft 36 is not openly exposed through the grip member 32, except possibly by a small air-release hole 46 to ease insertion grip member 32 over of the shaft 36. In keeping with this, the tine bores 42 are located radially outward from the shaft 36 and associated hollow 44.

The tines 40 are preferably relatively thin and cylindrical, however other shapes may be used. In an embodiment, each tine 40 has a diameter of approximately $^{9}/_{1000}$ in, although any suitable size may be used. With a ball mark repair tool 34 as described, a divot mark is easily repairable with an insertion and twisting motion in the turf. This is quicker than a shovel-type motion required by some conventional ball mark repair tools, such as the type mentioned above in connection with U.S. Pat. No. 4,799,684. Moreover, the tool of the present invention is less damaging to the turf when inserted through the ground for repair.

Also, in an embodiment, the tool handle 38 has at least one recess **48*a* or 48*b* shaped to securably receive a conventional ball marker 50. Preferably, both recesses 48*a* and 48*b* are provided, recess 48*a* being disposed in a top side of the tool handle 38 and recess 48*b* being disposed in a bottom side of the tool handle 38. This configuration conveniently stores two conventional ball markers 50 integrally in the grip 30**.

It should be understood that various changes and modifications will be apparent to those skilled in the art. Such changes and modifications may be made without departing from the spirit and scope of the invention and without diminishing its attendant advantages. For example, the edge 68, 68' might be nonspherical or beveled in shape. Therefore, such appended claims are intended to cover such changes and modifications.

What is claimed is:

1. A golf putter grip comprising:

a flexible grip member having a hollow adapted to receive a putter shaft, the grip member being shaped to substantially close the hollow at a top end; and a divot mark repair tool having a tool handle from which at least two generally parallel tines extend;

wherein the tines are receivable in bores in the grip member, the bores being aligned generally parallel to the hollow and being positioned radially outward of the hollow, so that the divot mark repair tool is integrally securable to the grip member.

2. The golf putter grip according to claim 1, wherein the tool handle includes:

a first recess shaped to securably receive a ball marker in an underside of the tool handle such that the first recess is disposed between the handle and grip member when the tines are inserted into the bores; and a second recess shaped to securably receive a ball marker on a top side of said handle opposite said underside.

* * * * *